United States Patent [19]

Shintani et al.

[11] Patent Number: 4,484,958

[45] Date of Patent: Nov. 27, 1984

[54] NON-MAGNETIC ALLOY HAVING HIGH HARDNESS AND GOOD WELDABILITY

[75] Inventors: Atsunobu Shintani, Hirakata; Yoshiaki Yamakami, Toyonaka; Hisashi Hiraishi, Kyoto, all of Japan

[73] Assignee: Kubota, Ltd., Osaka, Japan

[21] Appl. No.: 465,661

[22] Filed: Feb. 10, 1983

[30] Foreign Application Priority Data

Feb. 12, 1982 [JP] Japan ..... 57-21812

[51] Int. Cl.[3] ..... C22C 38/58

[52] U.S. Cl. ..... 148/38; 75/128 A; 75/128 V; 164/504; 164/448

[58] Field of Search ..... 75/128 A, 128 C, 128 G, 75/128 W, 128 V; 161/504, 442, 448, 468; 148/38, 37

[56] References Cited

U.S. PATENT DOCUMENTS 3,533,780 10/1970 Miyoshi et al. ..... 75/128 A 3,711,276 1/1973 Hellner et al. ..... 75/128 A

FOREIGN PATENT DOCUMENTS 876437 8/1961 United Kingdom ..... 75/128 A

OTHER PUBLICATIONS

Sakamoto et al., The Journal of the Iron and Steel Institute of Japan, vol. 67, Sep. 1981, p. 192.

*Primary Examiner*—L. Dewayne Rutledge

*Assistant Examiner*—Debbie Yee

*Attorney, Agent, or Firm*—Armstrong, Nikaido, Marmelstein & Kubovcik

[57] ABSTRACT

An alloy consisting essentially of, by weight, 0.1–0.6% C, up to 2.0% Si, 5.0–15.0% Mn, 5.0–15.0% Cr, 5.0–13.0% Ni, less than 1.0% V, and one or both of up to 1.0% Mo and up to 2.0% Nb, balance being substantially Fe and inevitable impurities. The alloy has outstanding nonmagnetic property, high hardness and good weldability, and particularly useful for electromagnetic stirrer rolls in continuous casting machine.

3 Claims, 3 Drawing Figures

NON-MAGNETIC ALLOY HAVING HIGH HARDNESS AND GOOD WELDABILITY

BACKGROUND OF THE INVENTION

The present invention relates to an improvement in non-magnetic austenitic stainless steel.

Pinch rolls are used in continuous casting machine for continuously withdrawing a slab or the like from a mold containing molten steel. When the slab passes between the pinch rolls, the inner portion of the slab is still in a molten state and is prone to segregation in the course of solidification. Accordingly an electromagnetic stirrer is provided for at least one of pinch rolls to produce a moving magnetic field and pass the slab through the magnetic field, thereby causing lines of magnetic force to stir the unsolidified inner portion of the slab to improve the quality of the portion. Rolls for use in electromagnetic stirrer are preferable to be the lowest in magnetic permeability so as to minimize the eddy current loss by electro-magnetic induction and to enhance an efficiency of electro-magnetic stirring. The electromagnetic stirrer rolls are also required to have high hardness in view of durability and further to have good weldability in view of maintenance works.

The materials heretofore used for such rolls include 0.03C—18Cr—8Ni steel (AISI 304). However, the steel is about 1.006 in magnetic permeability ($\mu$) and about 165 in Vickers hardness (VHN) and is not fully satisfactory in magnetic permeability and hardness, so that it is required to develop non-magnetic alloys having a lower magnetic permeability, higher hardness and better weldability.

SUMMARY OF THE INVENTION

The present invention fulfills the above-mentioned requirements.

An object of the invention is to provide an alloy consisting essentially of 0.1–0.6% (by weight, the same as hereinafter) C, $0<Si\leqq 2.0\%$, 5.0–15.0% Mn, 5.0–15.0% Cr, 5.0–13.0% Ni, $0<V<1.0\%$, and one or both of $0<Mo\leqq 1.0\%$ and $0<Nb\leqq 2.0\%$, the balance being substantially Fe and inevitable impurities.

The alloy of the present invention has an outstanding non-magnetic property of up to about 1.005 in magnetic permeability, high hardness of about 200 or higher than that in VHN and good weldability.

DETAILED DESCRIPTION OF THE INVENTION

Figure 1:
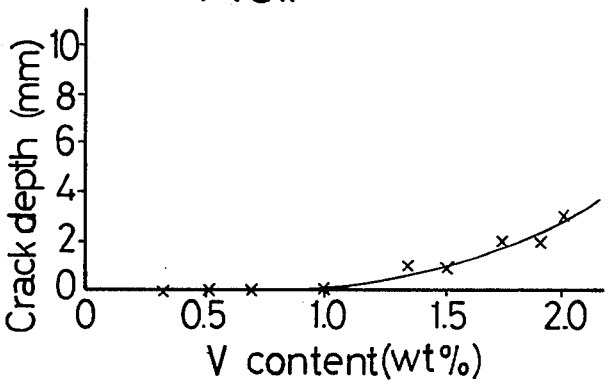
FIG. 1 is a diagram showing a correlation between underbead cracks and the V content according to Battele type underbead cracking test.

The reasons for limiting the components of the present alloy as above will be described below.

C: 0.1–0.6%

C is a useful element for forming austenite to render the alloy non-magnetic and is also necessary to give increased hardness. The C content, if less than 0.1%, is not fully effective in affording hardness. Although this effect can be enhanced by increasing the content, an excess of C results in reduced toughness and adversely leads to increased permeability through the coarse-grained carbides, so that the C content should be up to 0.6%. $0<Si\leqq 2.0\%$ Si, which must be used as a deoxidizer, acts as a ferrite forming element and increases the magnetic permeability when present in a large amount. To avoid the objectionable effect, the Si content should not exceed 2.0%.

Mn: 5.0–15.0%

Mn is essential to the alloy as a deoxidizing and desulfurizing element and also as an austenite forming and stabilizing element for non-magnetization. It is desired that at least 5% of Mn be present for stabilizing the austenitic phase. However, when containing Mn in an excessively large amount, the alloy becomes to less resistant to oxidation at high temperatures in addition to its reduced hardness, so that the upper limit of the Mn content is 15.0%.

Cr: 5.0–15.0%

Cr is effective for giving improved resistance to oxidation and higher hardness. To be fully effective, Cr is preferably present in an amount of at least 5.0%. At a high content, however, Cr which forms ferrite renders the austenitic phase instable. It is therefore desired that the Cr content be up to 15.0%. Ni: 5.0–13.0%

Ni is a very useful element for forming austenite. At least 5.0% of Ni must be present for the formation and stabilization of austenite. However, the increase of the Ni content leads to reduced hardness, so that the upper limit for the Ni content is 13.0%. $0<V<1.0\%$ V is effective for producing finer grains, thereby contributing to the improvement of toughness. However, V forms ferrite to render the magnetic permeability higher with the increase of its content. The V content in the present alloy should therefore be less than 1.0% to keep the magnetic permeability stable in lower value. In order to enjoy an effect of toughness improvement by fined grains, it is preferable that at least 0.1% of the V element is contained, nevertheless effective even in a trace amount. As shown in the example later, weldability is also improved by the V content thus restricted to less than 1.0%. $0<Mo\leqq 1.0\%$, $0<Nb\leqq 2.0\%$ Both Mo and Nb produce improved hardness through the solution hardening of carbides. However, these elements, which form ferrite, impair the stability of the austenitic phase if used in large amounts. To avoid this objection, it is preferred that the Mo content be up to 1.0%, and the Nb content up to 2.0%. Although one of these elements is usable singly, both elements, if used conjointly, will produce a synergistic effect to give greatly increased hardness.

While it is desirable that the alloy contain P, S and other impurities in minimized amounts, no particular objection will result if these impurities are such that they become inevitably incorporated into the alloy in an industrial alloy manufacturing process.

The alloy of this invention is subjected to solution heat treatment in the usual manner, and the supersaturated austenite is allowed to stand at room temperature. The resulting alloy has outstanding non-magnetic property, i.e. low magnetic permeability, and high hardness. The alloy is also excellent in weldability.

The present invention will be described below in more detail with reference to the following exmples.

Example 1

Alloy specimens of various compositions were prepared, then subjected to solution treatment (1100° C.×3 hr., cooling with water) and thereafter checked for magnetic permeability (μ) and hardness (VHN). The magnetic permeability (μ) was measured by Phörster Probe magnetic permeability tester. The hardness was measured by Vickers hardness tester under a load of 10 kg.

Table 1 shows the chemical compositions of the specimens and the magnetic permeability and hardness values thereof measured. Specimens Nos. 1 to 6 are alloys of the invention, and specimens Nos. 7 to 19 are the alloys compared with those of the invention in respect of the magnetic permeability and hardness. Specimen No. 19 is the material of AISI 304 which has been conventionally used for electro-magnetic stirrer rolls.

As understood from Table 1, the present alloys (Specimens No. 1 to 6) are superior to the conventionally used material of AISI 304 (Specimens No. 19) in both non-magnetic property and hardness.

The other comparison specimens of Nos. 7 to 18 with contents of some components outside the ranges defined by the invention are all inferior to the alloy of the invention in non-magnetic property, and further, some being insufficient in hardness although relatively low in magnetic permeability and some being not satisfactory in non-magnetic property although high in hardness. Thus the comparison alloys simultaneously fail to satisfy both characteristics.

TABLE 1

| | Chemical composition (wt %), Magnetic permeability and Hardness | | | | | | | | | | |
|---|---|---|---|---|---|---|---|---|---|---|---|
| No. | C | Si | Mn | Cr | Ni | V | Mo | Nb | Magnetic permeability (μ) | Vickers hardness (VHN) | |
| 1 | 0.15 | 0.70 | 8.0 | 7.5 | 8.5 | 0.50 | 0.6 | — | 1.002 | 216 | Alloy |
| 2 | 0.32 | 0.80 | 9.1 | 8.0 | 9.5 | 0.60 | 0.3 | — | 1.003 | 232 | Invention |
| 3 | 0.51 | 0.90 | 9.0 | 8.8 | 9.2 | 0.55 | 0.7 | — | 1.002 | 237 | |
| 4 | 0.48 | 0.84 | 9.3 | 8.9 | 9.1 | 0.48 | 0.5 | — | 1.003 | 231 | |
| 5 | 0.52 | 0.98 | 8.5 | 8.7 | 10.1 | 0.52 | — | 1.1 | 1.003 | 229 | |
| 6 | 0.50 | 0.88 | 9.2 | 9.0 | 9.8 | 0.45 | 0.8 | 1.2 | 1.002 | 230 | |
| 7 | 0.01 | 0.90 | 8.2 | 9.1 | 7.6 | 0.70 | 0.8 | — | 1.005 | 172 | Alloy |
| 8 | 0.05 | 0.80 | 9.1 | 8.8 | 8.7 | 0.50 | 0.7 | — | 1.006 | 174 | Comparison |
| 9 | 0.52 | 0.70 | 2.8 | 7.8 | 9.2 | 0.60 | 0.4 | — | 1.015 | 185 | |
| 10 | 0.47 | 0.80 | 18.2 | 8.2 | 8.6 | 0.70 | 0.6 | — | 1.005 | 195 | |
| 11 | 0.55 | 0.90 | 9.2 | 3.5 | 8.8 | 0.60 | 0.7 | — | 1.005 | 182 | |
| 12 | 0.51 | 0.70 | 9.0 | 16.9 | 7.8 | 0.50 | 0.6 | — | 1.012 | 205 | |
| 13 | 0.52 | 0.60 | 8.3 | 9.1 | 1.9 | 0.40 | 0.5 | — | 1.015 | 202 | |
| 14 | 0.54 | 0.90 | 8.6 | 8.9 | 17.2 | 0.60 | 0.6 | — | 1.004 | 172 | |
| 15 | 0.49 | 0.80 | 8.8 | 8.2 | 9.1 | — | 0.7 | — | 1.005 | 192 | |
| 16 | 0.51 | 0.90 | 8.3 | 8.6 | 9.3 | 4.2 | 0.8 | — | 1.012 | 248 | |
| 17 | 0.46 | 0.70 | 8.9 | 9.2 | 8.9 | 0.6 | 2.5 | — | 1.013 | 233 | |
| 18 | 0.49 | 0.80 | 8.5 | 8.9 | 9.2 | 0.5 | 0.7 | 4.2 | 1.014 | 251 | |
| 19 | 0.05 | 0.70 | 0.8 | 18.1 | 9.0 | — | 0.3 | — | 1.006 | 165 | |

(Balance being substantially Fe and inevitable impurities)

Example 2

Figure 2A:
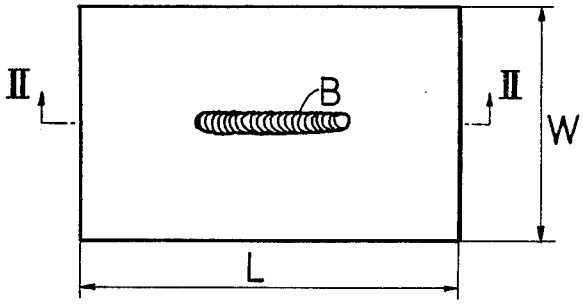
FIG. 2*a* is a plan view showing a test piece used for Battele type underbead cracking test.
Figure 2B:
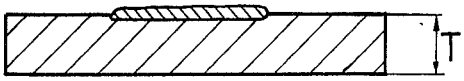
FIG. 2*b* is a sectional view taken along the line II—II of FIG. 2*a*.

Alloy specimens from the material of 0.35C—0.75Si—8.95Mn—8.80Cr—9.05Ni—0.86Mo—1.46Nb—V—Fe were prepared, wherein the V content was variously changed, and checked for weldability under Battele type underbead cracking test. From the above specimens, plate-like test pieces were obtained having the dimension of width (W) 50.8 mm×length (L) 76.2 mm×thickness (T) 25.4 mm as shown in FIGS. 2*a* and 2*b*. Weld bead (B) of 31.75 mm length was provided on the surface of such test pieces. The test pieces after providing the weld bead were passed a day and a night and thereafter were cut off along the center line (II—II line in FIG. 2*a*) thereof. The results are shown in FIG. 1. It can be taken from the test results that the alloys having the V content of less than 1.0% are free from weld crack and thus are excellent in weldability.

The alloy of the invention has the great feature in that it is particularly excellent in weldability, in addition to the properties of low magnetic permeability and high hardness.

As understood from the foregoing, the alloy of this invention has low magnetic permeability and high hardness and is therefore suited as the material for electromagnetic stirrer rolls for use in continuous casting machine. Because such stirrer rolls prepared from the present alloy effectively agitate the inner unsoldified portion only of the slab passing thereover without being magnetized themselves owing to the outstanding non-magnetic characteristics, the rolls achieve an improved energy efficiency while having enhanced durability afforded by the high hardness. The alloy of the invention is also excellent in weldability and therefore advantageous for maintenance works.

The alloy of the invention is not only useful for electromagnetic stirrer rolls of continuous casting machine but is of course usable for various other apparatus, such as nuclear fusion apparatus, linear motor cars, etc., as components thereof which must have low magnetic permeability and high hardness. The alloy of the invention is also suited as the material for structural use in view of good weldability.

The present invention is not limited to the foregoing description but can be readily modified variously by one skilled in the art without departing from the spirit of the invention. Such modifications are included within the scope of the invention.

What is claimed is:

1. An electromagnetic stirrer roll adapted for use in continuous casting, said roll being formed of an alloy having high hardness, low magnetic permeability and good weldability, and consisting essentially of the following components in the following proportions in terms of % by weight:

| | |
|---|---|
| C | 0.1-0.6% |
| 0<Si≦2.0% | |

-continued

| | |
|---|---|
| Mn | 5.0–15.0% |
| Cr | 5.0–15.0% |
| Ni | 5.0–13.0% |
| 0<V<1.0%, and | |

one or both of 0<Mo≦1.0% and 0<Nb≦2.0%, the balance being substantially Fe and inevitable impurities.

2. The alloy as defined in claim 1 wherein the V content is at least 0.1% and less than 1.0%.

3. In a process for continuous casting wherein a slab having a molten inner portion is contacted with electromagnetic stirrer rolls, the improvement wherein said stirrer rolls are an alloy consisting essentially of the following components in the following proportions in terms of % by weight:

| | |
|---|---|
| C | 0.1–0.6% |
| 0<Si≦2.0% | |
| Mn | 5.0–15.0% |
| Cr | 5.0–15.0% |
| Ni | 5.0–13.0% |
| 0<V<1.0%, and | |

one or both of 0<Mo≦1.0% and 0<Nb≦2.0%, the balance being substantially Fe and inevitable impurities.

* * * * *